United States Patent [19]

Oden

[11] 4,036,400

[45] July 19, 1977

[54] TANDEM COLUMN VENDER ANTI THEFT DEVICE

[75] Inventor: Kenneth W. Oden, Charles Town, W. Va.

[73] Assignee: Dixie-Narco, Inc., Ranson, W. Va.

[21] Appl. No.: 711,828

[22] Filed: Aug. 5, 1976

[51] Int. Cl.[2] ..... G07F 11/08

[52] U.S. Cl. ..... 221/67

[58] Field of Search ..... 221/67, 114, 115, 116, 221/117, 118

[56] References Cited

U.S. PATENT DOCUMENTS

| | | | |
|---|---|---|---|
| 2,988,246 | 6/1961 | Johnson et al. | 221/67 |
| 3,356,259 | 12/1967 | O'Neal | 221/118 |
| 3,796,345 | 3/1974 | Fessler | 221/67 |

*Primary Examiner*—Robert B. Reeves
*Assistant Examiner*—Francis J. Bartuska
*Attorney, Agent, or Firm*—Bacon & Thomas

[57] ABSTRACT

A vending machine has a compartment dimensioned to hold at least two columns of cylindrical articles with the articles in axial alignment, front to rear. A bail structure has upper and lower bail bars swingable about a central fore and aft axis, to opposite sides thereof. The lower bail bar, when in one lateral position, supports the bottom articles of both the columns while the upper bail bar supports all other articles in the compartment. The lower bail bar is laterally wider under the rear column than under the front column so that partial swinging of the bail releases the bottom article from only the front column and further swinging releases the bottom article of the rear column. An anti theft member hangs pendulously from the upper bail, in the front column, and serves to prevent movement of a rear column article resting on the lower bail from moving into the front column after an article in the front column has been released from the lower bail.

6 Claims, 5 Drawing Figures

TANDEM COLUMN VENDER ANTI THEFT DEVICE

BACKGROUND OF THE INVENTION

This invention is in the field of dispensing devices.

Dispensing machines for dispensing cans of beverages or the like have been used heretofore and wherein a cabinet provided for the stacking of adjacent columns of articles with the articles aligned in a front to rear direction and wherein swingable bail means were provided to release the bottom articles, one at a time, from one column and then the other. Such devices often included means on a swingable bail or similar device to retain one article while the other was dropped therepast to a discharge station. Such machines, however, were subject to surreptitious theft of articles. This was possible by legitimately operating the machine to dispense the first article and then to violently shake or tilt the machine to cause the retained bottom article to move into the column previously occupied by the dispensed article whereupon that second article would be dispensed without deposit of an additional coin. Efforts were made to prevent such manipulation by providing partitions or partial partitions in the form of ribs between the front and rear columns. However, this necessitated a more expensive cabinet structure and had further disadvantages in that the ribs or partitions would often interfere with proper loading of the machine and in some instances would interfere with proper flow of the articles to the dispensing mechanism.

SUMMARY OF THE INVENTION

The present invention involves a simple pendulous member on a swingable dispensing bail functioning to block movement of a non-dispensed article into a column from which an article has previously been dispensed.

It is, therefore, a principal object of this invention to provide a reliable, inexpensive and easily constructed anti theft defice for an article dispensing machine.

A further object is to provide a device in accordance with the previous object wherein the anti-theft device may be left in place when the apparatus is used to dispense a single column of longer articles without interfering with such operation.

DESCRIPTION OF A PREFERRED EMBODIMENT

Figure 3:
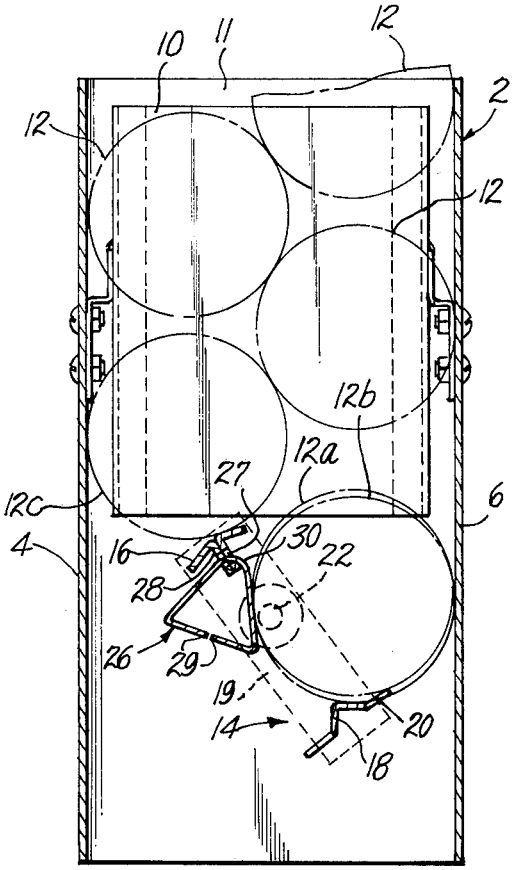
FIG. 3 is a vertical transverse sectional view taken on the line 3—3 of FIG. 1.
Figure 4:
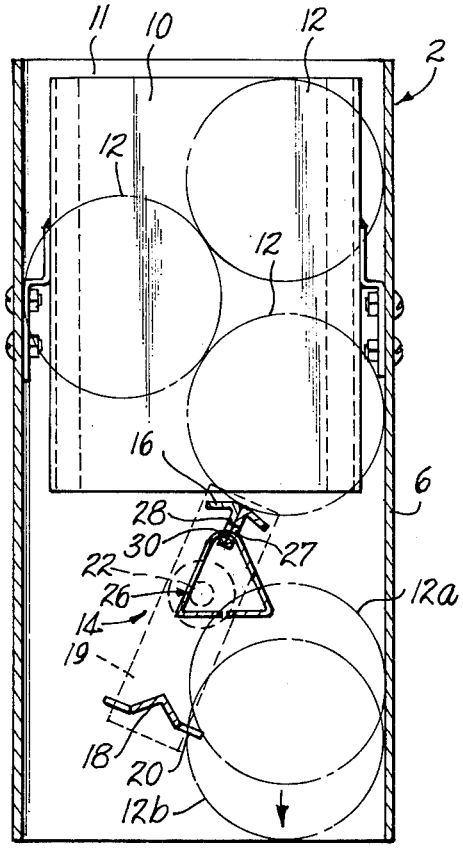
FIG. 4 is a view similar to FIG. 3 but showing the parts in different relative positions.

The present invention is incorporated in a machine having one or more compartment assemblies 2 each having side walls 4 and 6 and end walls 8 and 11. An inner end wall 10 is shown as being adjustable in a front to rear direction to accommodate articles of different lengths. As shown in FIGS. 3 and 4, the compartment is of such dimensions that it can hold four columns of generally cylindrical articles 12 with the two front columns being in vertically staggered and overlapping relation and two more columns therebehind also being in staggered relation. A swingable bail structure 14 comprises an upper bail 16 and a lower bail 18 mounted on end supports 19 which in turn carry shafts 22 and 24 by which the bail structure is pivotally mounted on the front and rear end walls 8 and 11 of the compartment referred to. Operating mechanism 25 is operable by suitable controls, not shown, to oscillate the bail structure 14 about the axis defined by shafts 22 and 24. The lower bail 18 extends below both front and rear columns, as does the bail 16, and is provided with an extending flange portion 20 in the rear column, that is, below the articles 12 in the rear portion of the compartment. Reference herein to front or rear "columns" refers to those regions in compartment 2 occupied by the columns of articles, even though no physical structure separates those regions. When the bail is swung to the position shown in FIG. 3, the lower articles of the right hand columns drop onto that bail while the bail 16 supports all of the other articles in the compartment. The article **12*a* in the rear column rests on the edge of the flange 20 whereas the article 12*b* in the front column rests on the narrower portion of bail 14, both articles engaging the side wall 6 as shown. The bail structure 14 may be caused to swing to the position shown in FIG. 4, by deposit of a proper coin or coins in the machine and in that position the front article 12*b* passes between the narrow portion of the bail 18 and side wall 6 and drops to a dispensing station. The flange 20, however, retains the rear article 12*a*** as shown until another coin is deposited and the bail is caused to swing farther clockwise.

All of the above described structure and operation is known and conventional, being fully shown and described in applicant's copending application Ser. No. 626,643, filed Oct. 29, 1975 now U.S. Pat. No. 4,019,650. The present invention constitutes an improvement on the invention described and claimed in the prior application and reference is made thereto for a more detailed description.

When the bail 14 is in the position shown in FIG. 4, having permitted article **12*b* to be dispensed while retaining article 12*a*, it would be possible to so rock and tilt the cabinet housing compartment 2 so as to cause the article 12*a* to slide longitudinally and forwardly off the flange 20 into the front column region and to a position where it could drop to the dispensing station without depositing another coin in the machine. As stated previously, such improper operation could be prevented by providing the side walls 4 and 6** with vertical ribs or partitions extending between the front and rear columns of articles but such would add materially to the cost of the apparatus and would have the disadvantages already pointed out.

Figure 1:
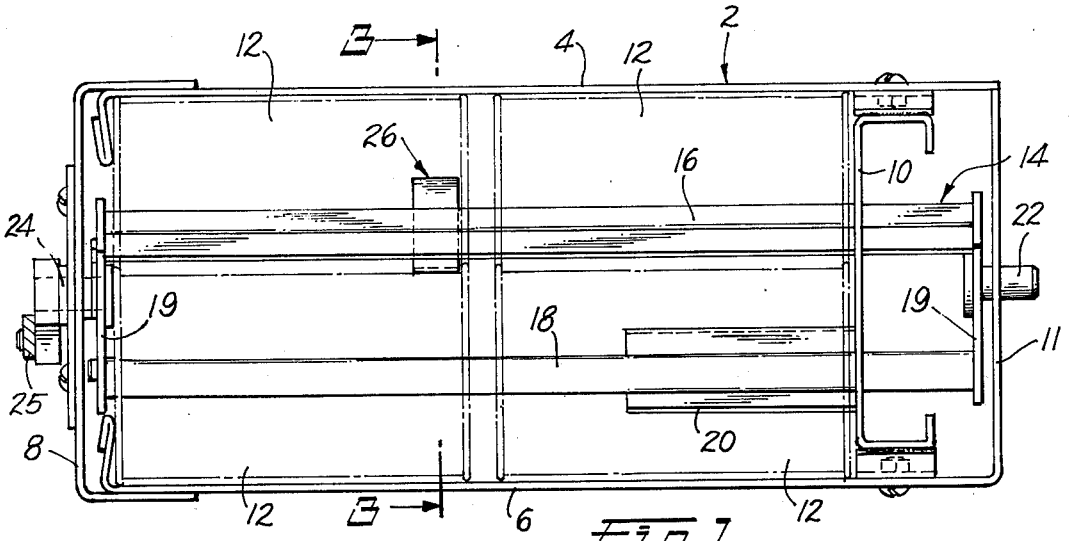
FIG. 1 is a top plan view showing a portion of a dispensing machine embodying the present invention.
Figure 2:
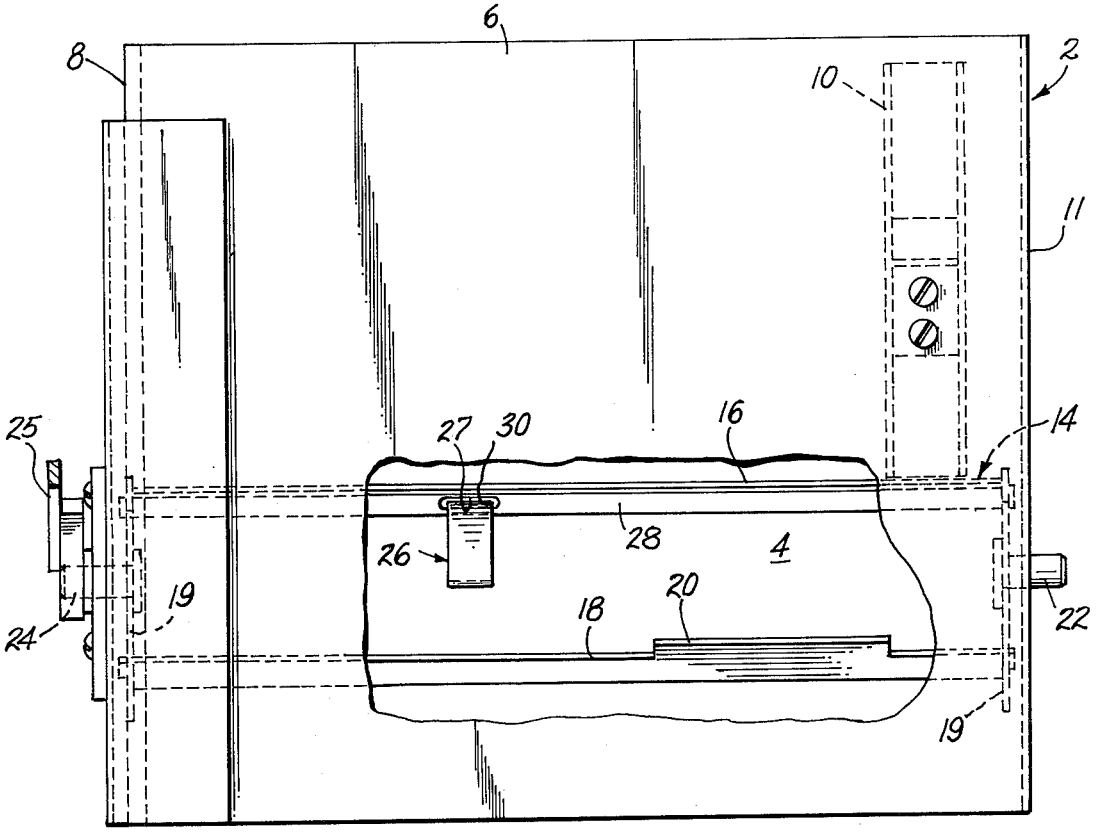
FIG. 2 is a side elevational view of the structure of FIG. 1 with parts broken away to show the interior thereof.
Figure 5:
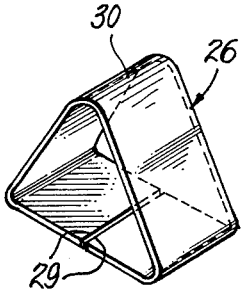
FIG. 5 is a perspective view, on an enlarged scale, of the anti-theft device of the present invention.

As shown in the prior application referred to and in FIGS. 3 and 4, the upper bail 16 is formed of sheet metal and is provided with a generally central depending flange means 28. As shown in FIG. 2, the flange 28 is provided with a longitudinal slot 27 at a location therealong that is within the front column, that is, within the path followed by the articles **12*b* in the front part of the compartment 2. An anti theft device 26 is in the form of a strip of spring steel bent to the generally triangular configuration best shown in FIG. 5. The ends 29 of the strip are left free of each other so that the ends may be sprung apart sufficiently to insert the device in the slot 27 to assume the position clearly shown in the figures. The upper apex portion 30 of the element 26 is in the form of a reversely bent portion by which the element 26 is pendulously suspended from the upper bail 16. The width and thickness of the strip material of device 26 is only slightly less than the corresponding dimensions of slot 27** so that it is freely swingable but substantially confined to a single lateral plane.

From the showing of FIG. 3, it is apparent that the element 26 does not interfere with downward movement of the bottom can **12*b* either to a position on lower bail 18 or to the dispensing position at FIG. 4. After the article 12*b* has been dispensed, the pendulous element 26 is free to swing downwardly to the position shown in FIG. 4 where at least a portion thereof extends into the projected outline of rear article 12*a*. As will be obvious from FIGS. 4 and 2, the element 26 thus blocks article 12*a* from moving forwardly off flange 20 and prevents such improper obtaining of article 12*a* by tilting or otherwise manipulating the cabinet structure in which the compartment 2** is mounted.

Dispensers of this type may be employed to dispense articles arranged in front and rear columns as shown or to dispense longer articles arranged in a single column. Such longer articles may, for example, be bottles or the like and it is obvious that no modification of the apparatus is necessary to adapt it to such other use, except possibly, adjustment of inner rear wall 10 and thus the anti-theft device 26 will not interfere with the normal operation of the apparatus when dispensing from single columns of longer articles.

Even though the articles **12*a*** illustrated herein are in the form of cans having end flanges or ribs, a sufficiently violent tilting or manipulation of an apparatus without this anti-theft device could result in improper dispensing of the rear article as described. The ease with which this can be accomplished is increased when the cans employed are of the type having no projecting end flanges, wherein the body of the can is of a diameter at least as great as the outer diameter of the crimped end closures.

The foregoing description refers only to a single pair of front and rear columns of articles, the right-hand columns of FIGS. 3 and 4. It will be obvious to those skilled in the art that the operation of the device relative to the left-hand columns will be identical. Actually, when the bail 14 reaches the position of FIG. 4 the bottom cans **12*c* (FIG. 3) of the left-hand columns will have dropped onto the left side of lower bail 18 and the front article 12 will tilt the element 26 farther to the right than shown in FIG. 4, rendering it even more effective to block article 12*a*. After the last available article 12 has been dispensed from the left-hand columns, the element 26 will hang as shown in FIG. 4**. Obviously this invention may be used with a single pair of front and rear columns or with the overlapping pairs of columns shown.

While a single specific embodiment of the invention has been shown and described herein, the same is merely illustrative of the principles involved and other forms may be employed within the scope of the appended claims.

I claim:

1. In a vending apparatus having means, including a planar side wall, defining a compartment for containing and confining at least two columns of generally cylindrical articles with articles of one column axially displaced from the articles of the other column in a front to rear direction, a longitudinally extending lower bail extending below both columns in supporting relation to at least the bottom articles thereof and being swingable about a fore-and-aft axis for lateral movement from a first position supporting said articles to a terminal position wherein all portions thereof are sufficiently spaced from one side wall to permit downward passage of said articles therebetween, said bail having a laterally extending portion below only one of said columns extending farther toward said side wall than the remainder of said bail whereby said bail may be moved laterally away from said side wall to permit the bottom article of the other column to drop therepast while said laterally extending portion supports the bottom article of said one column and further lateral movement of said bail to said terminal position then permits said bottom article of said one column to drop therepast, an upper bail in rigidly fixed relation to said lower bail and swingable therewith and arranged to swing into supporting engagement with those articles of said columns above said bottom articles in response to swinging movement of said lower bail away from said first position; the improvement comprising:

a member freely swingable and pendulously suspended from said upper bail, intermediate the ends thereof, to hang in said other column, adjacent said one column, in position to block movement of an article supported by said alterally extending portion into said other column when the bottom article of said other column has dropped past said lower bail.

2. Vending apparatus as defined in claim 1 wherein said pendulously suspended member extends downwardly sufficiently to engage a side of an article in said other column when said article is supported by said lower bail.

3. Vending apparatus as defined in claim 1 wherein said upper bail includes a longitudinal and downwardly extending flange portion and a longitudinal slot in said flange portion, said pendulously suspended member including a reversely bent strap portion extending loosely through said slot to suspend said member for swinging movement in only one plane transverse to said upper bail.

4. Vending apparatus as defined in claim 3 wherein said pendulously suspended member is a metal strap bent to triangular configuartion with an apex of said triangle constituting said reversely bent portion.

5. Vending apparatus as defined in claim 4 wherein said metal strap is of spring steel and has separable end portions whereby it may be sprung "open" for insertion into or removal from said slot.

6. Vending apparatus as defined in claim 3 wherein said strap portion is of a width and thickness only slightly less than the corresponding dimensions of said slot.

* * * * *